US008385809B2

(12) United States Patent
Shiokawa et al.

(10) Patent No.: US 8,385,809 B2
(45) Date of Patent: Feb. 26, 2013

(54) SHEET CUTTING DEVICE AND IMAGE FORMING SYSTEM PROVIDED THEREWITH

(75) Inventors: Tsuyoshi Shiokawa, Hachioji (JP); Hiroyuki Wakabayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 579 days.

(21) Appl. No.: 12/620,863

(22) Filed: Nov. 18, 2009

(65) Prior Publication Data

US 2010/0132525 A1 Jun. 3, 2010

(30) Foreign Application Priority Data

Nov. 29, 2008 (JP) ..... 2008-305749

(51) Int. Cl.
*G03G 15/00* (2006.01)

(52) U.S. Cl. ..... 399/407; 399/408; 83/72; 83/76.1; 83/76.6

(58) Field of Classification Search ..... 101/45; 399/407, 408; 12/45; 83/69, 203, 72, 76.1, 83/76.6, 76.7, 76.9

See application file for complete search history.

(56) References Cited

U.S. PATENT DOCUMENTS

| | | | | |
|---|---|---|---|---|
| 5,488,886 | A * | 2/1996 | Mohr | 83/29 |
| 6,356,798 | B1 * | 3/2002 | Gottschalk et al. | 700/127 |
| 2006/0011040 | A1 * | 1/2006 | Uchiyama et al. | 83/697 |

FOREIGN PATENT DOCUMENTS

| | | | |
|---|---|---|---|
| JP | 2001-088091 | A | 4/2001 |
| JP | 2006-51592 | A | 2/2006 |
| JP | 2006-297535 | A | 11/2006 |

OTHER PUBLICATIONS

Japanese Office Action dated Dec. 11, 2012 (and English translation thereof) in counterpart Japanese Application No. 2008-305749.

* cited by examiner

*Primary Examiner* — Matthew G Marini
(74) *Attorney, Agent, or Firm* — Holtz, Holtz, Goodman & Chick, PC

(57) ABSTRACT

A sheet cutting device includes: an interposing section that interposes a sheet bundle in which a plurality of sheets are bundled; a cutting blade section having a cutting blade that cuts a sheet bundle interposed by the interposing section; a blade receiving member that receives a cutting edge of the cutting blade in the case of cutting; and a controller that controls a stop position of the cutting blade in the case of cutting. The controller controls the cutting blade section so that an amount of movement from a standby position of the cutting blade to the stop position becomes great when the number of times of cutting operations is increased.

11 Claims, 11 Drawing Sheets

SHEET CUTTING DEVICE AND IMAGE FORMING SYSTEM PROVIDED THEREWITH

This application is based on Japanese Patent Application No. 2008-305749 filed on Nov. 29, 2008, which is incorporated hereinto by reference.

BACKGROUND OF THE INVENTION

The present invention relates to a sheet cutting device that cuts a sheet bundle and relates to an image forming system equipped with the sheet cutting device.

Up to now, there has been put to practical use a sheet finisher equipped with a sheet cutting device that aligns an edge of a sheet bundle by cutting an edge portion of the sheet bundle, for sheet bundles processed in terms of center stapling or of center folding, in the business world of printing.

Further, in recent years, there has been made an for a sheet finisher equipped with a sheet cutting device that conducts center stapling processing or center folding processing after receiving a sheet on which an image has been formed by a main body of an image forming apparatus such as a copying machine or a printer, and aligns an edge portion by cutting the edge portion of a sheet bundle with the sheet cutting device, after bookbinding, as in the case of the weekly magazines.

Many of the sheet cutting devices of this kind are those wherein a sheet bundle is fixed on a placing stand, and a cutting blade is moved for cutting operations. In this case, a position for the cutting blade to be stopped is established to be a position where a cutting edge of the cutting blade intrudes slightly into a blade receiving section that is provided on the side of the placing stand.

A stop position of the cutting edge is sometimes varied by influences of operation errors and manufacturing errors, and in this case, there are caused problems such as unfinished cutting and excessive intrusion of a cutting edge of the cutting blade into the blade receiving section.

In Unexamined. Japanese Patent Application Publication No. 2006-297535, there is disclosed a sheet cutting device wherein an electric current value of a motor that increases gradually with an increase of loads caused by striking of a blade holder against a stopper in the ca cutting sheets, detected to control the stop position for a blade. Owing to the aforesaid device, excessive force is not applied on a cutting edge, resulting in promotion of a long life.

A surface of the blade receiving section is damaged little by little, each time a bundle of sheets is cut by a cutting blade. When damage on a surface of the blade receiving section grows to be too large, cutting ability is lowered. In the sheet cutting device disclosed in Unexamined Japanese Patent Application Publication No. 006-51592, when the number of times of cutting reaches a prescribed number, the blade receiving section is shifted in the direction perpendicular to the cutting edge to renew a surface to be used of the blade receiving section, so that defective cutting that is caused by deterioration of a surface of the blade receiving section may not occur. Then, when the surface to be used of the blade receiving section becomes impossible to be renewed after being used up, the blade receiving section is replaced with a new one.

A blade and a blade receiving section of the sheet cutting device are deteriorated when cutting operations are repeated, and the blade and the blade receiving section need to be replaced for the prescribed number of cutting operations. For extending a replacement cycle of a blade by decreasing damages of the blade, it is better for the blade receiving section to be made of a softer material. However, in that case, the blade receiving section tends to be damaged easily, resulting in a short cycle of replacement of the blade receiving section. It is also possible to make a size of the blade receiving section to be large for the purpose of extending a replacement cycle for the blade receiving section. In that case, however, there is caused a problem that the device grows to be gigantic.

In the sheet cutting device described in Unexamined Japanese Patent Application Publication No. 2006-297535, there is employed construction to detect an elastic current value of a motor and thereby to stop the blade by load fluctuations in the case of striking of a holder against a stopper. However, there is no consideration about an influence on the blade receiving section, and it is feared that accurate cutting of a sheet bundle is disturbed by deterioration of the blade receiving section.

In the sheet cutting device described in Unexamined Japanese Patent Application Publication No. 2006-51592, a replacement cycle is extended by renewing a surface used of the blade receiving section. However, an object of this construction IC not using the blade receiving section effectively, and when the blade receiving section is deteriorated so early by fluctuations of a biting amount of blade receiving section of the blade, it is feared that defective cutting may be caused.

SUMMARY OF THE INVENTION

An embodiment of the present invention is as follows.

A sheet cutting device composed of interposing section that interposes a sheet bundle in which a plurality of sheets are bundled, a cutting blade section equipped with a cutting blade that cuts a sheet bundle interposed by the aforesaid interposing section, a blade receiving member that receives a cutting edge the aforesaid blade in the case of cutting and a controller that controls a stop position of the aforesaid blade in the case of cutting, wherein the aforesaid controller controls the aforesaid cutting blade section so that an amount of movement from a standby position of the blade to the stop position may become great when the number of times of cutting operations is increased.

An image forming system characterized, to have an image forming apparatus that forms an image on a sheet, and a sheet finisher that is equipped with the aforesaid sheet cutting device, and forms a sheet bundle by bundling sheets on which images have been formed by the aforesaid image forming apparatus, and conducts cutting of the sheet bundle with the aforesaid sheet cutting device.

DETAILED DESCRIPTION OF THE PREFERRED EMBODIMENT

The invention will be explained as follows based on an embodiment to which, however, the invention is not limited.

Figure 1:
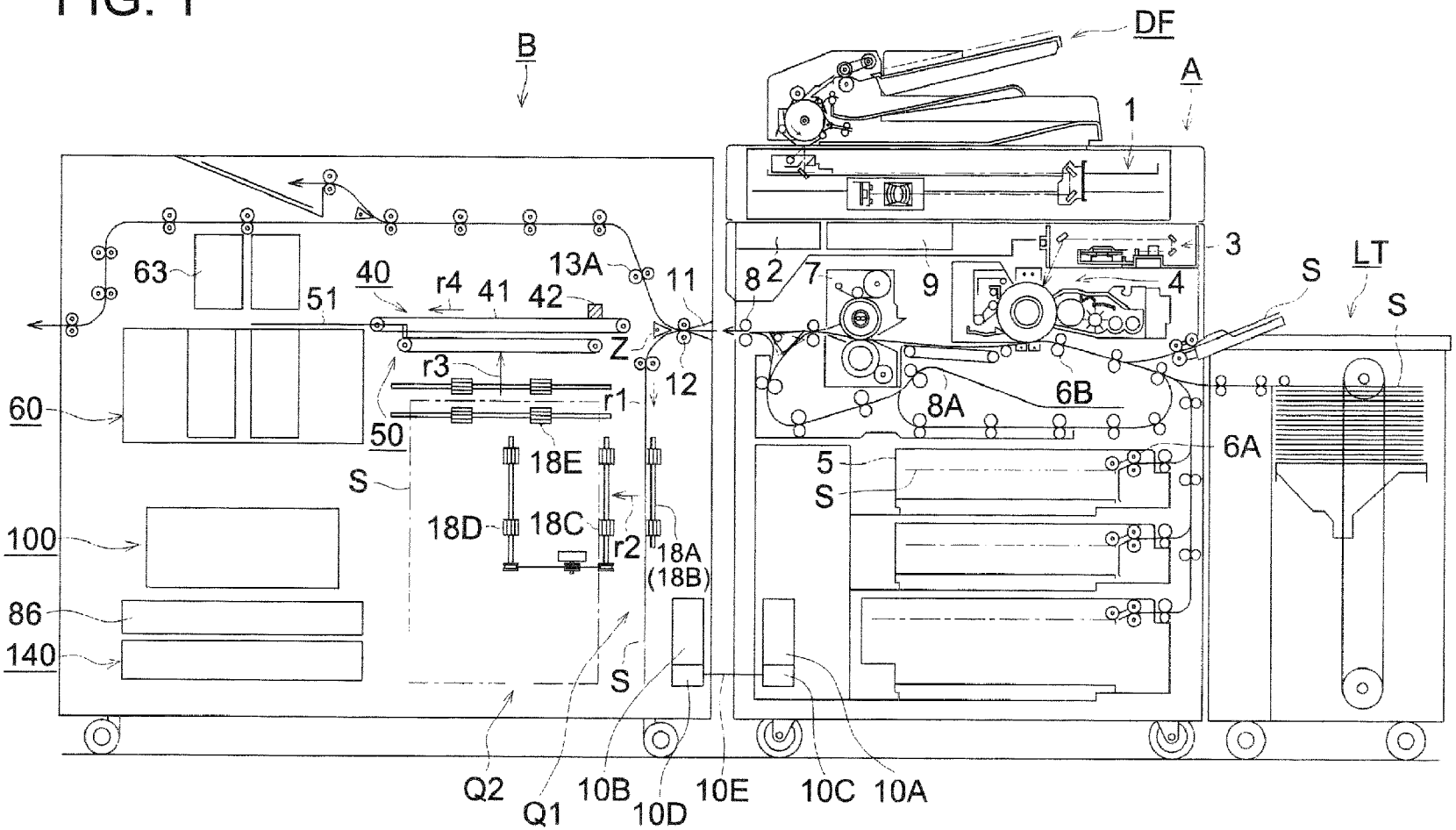
FIG. 1 is a sectional view of an image forming system wherein sheet finisher B that conducts center stapling processing and cutting processing is connected to the sheet ejection side of image forming apparatus A.

FIG. 1 is a sectional view of an image forming system wherein sheet finisher B that conducts center stapling processing and cutting processing is connected to the sheet ejection section side of image forming apparatus A. The cutting processing is conducted in sheet cutting device 100. Meanwhile, the sheet finisher having therein the built-in sheet cutting device relating to the invention can also be of the construction that can be used independently. Incidentally, the image forming system equipped with the sheet finisher of the invention and with a sheet finisher is not limited to the following embodiment.

[Image Forming Apparatus A]

Image forming apparatus A shown in FIG. 1 is equipped with image reading section 1, image processing section 2, image writing section 3, image forming section 4, sheet cassette 5, first sheet feeding section 6A, second sheet feeding section 6B, fixing device 7, sheet ejection section 8 and with automatic two-sided copy feeding unit (ADU) 8A.

Sheet finisher B having sheet cutting device 100 is connected to the sheet ejection section 8 side on the illustrated left side surface of the image forming apparatus A.

Operation section 9 selects and sets processing functions of an image forming system composed of image forming apparatus A and sheet finisher B.

Main control section 10A of the image forming apparatus A is connected to sheet finisher control section 10B of sheet finisher B, through communication sections 10C, 10D and communication line 10E.

[Sheet Finisher B]

Figure 2:
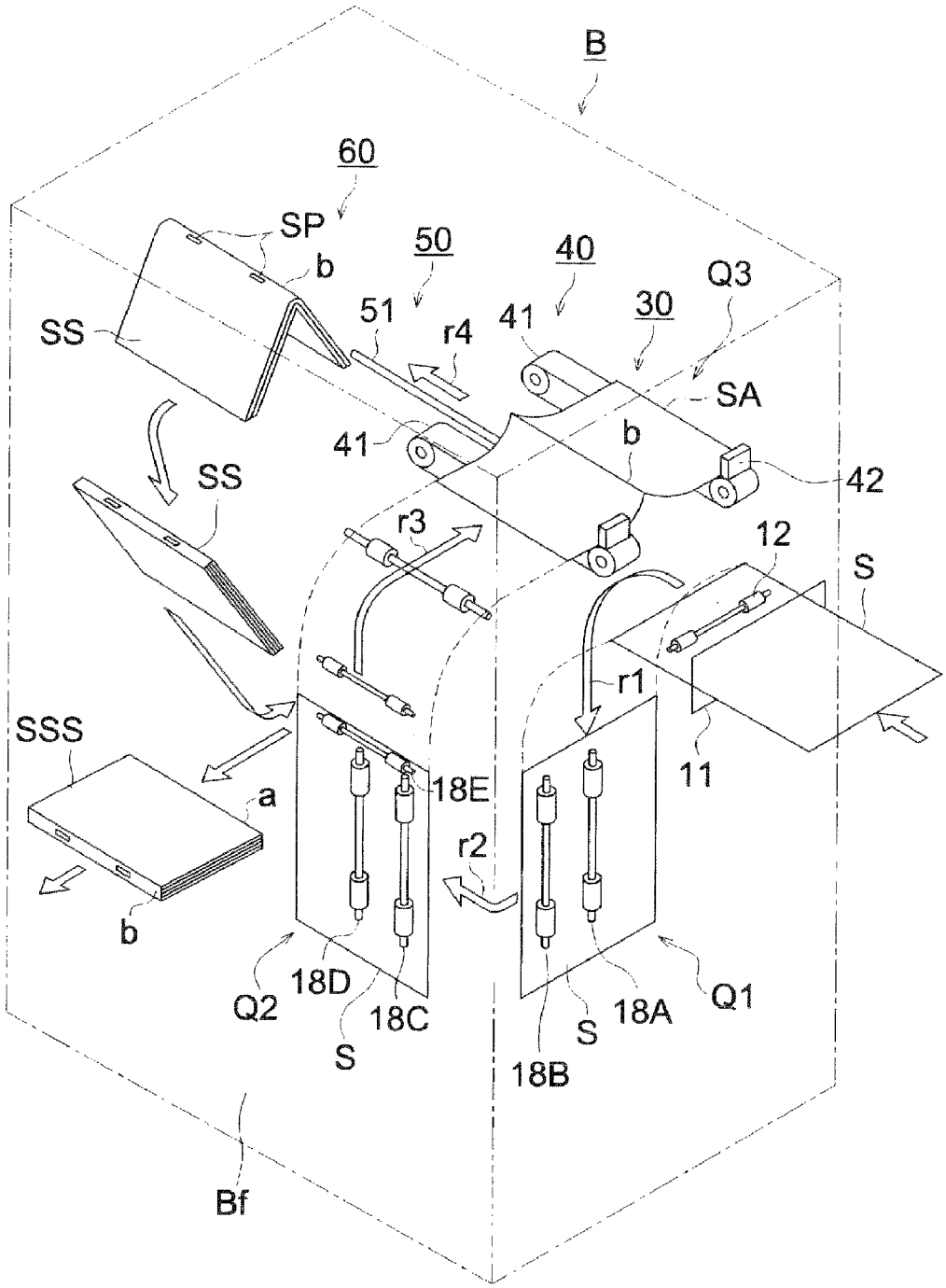
FIG. 2 is a schematic diagram showing sheet conveyance for center folding and center stapling which are carried out by sheet finisher B.
Figure 3:
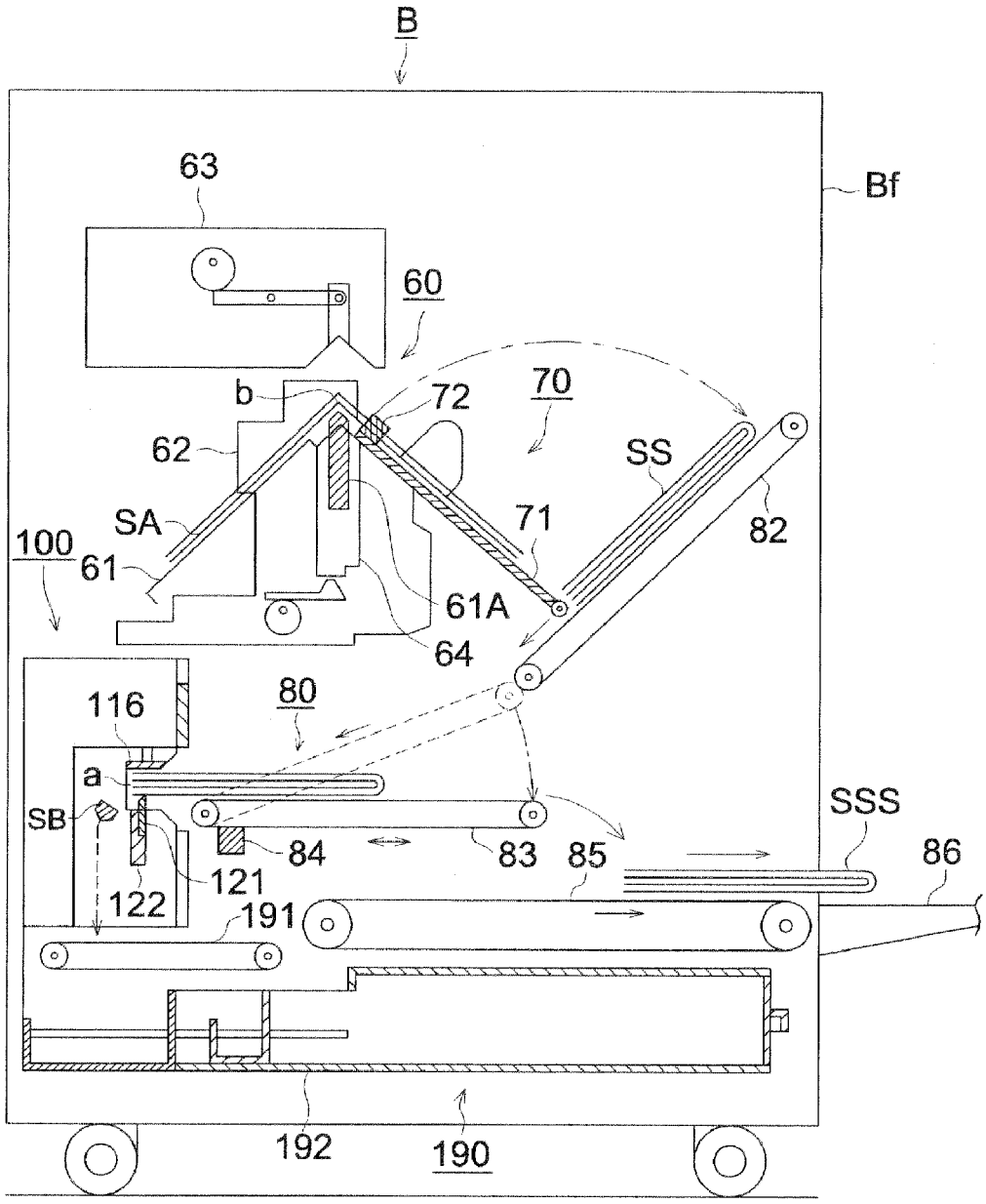
FIG. 3 is a side view on the left side for sheet finisher B.

FIG. 2 is a schematic diagram showing sheet conveyance for center folding and center stapling of sheet finisher B. FIG. 3 is a left side view of sheet finisher B.

As shown in the aforesaid drawings, after the bookbinding operations such as center folding and center stapling are established in operation section 9, sheet S ejected from the image forming apparatus A is guided into entrance section 11 of sheet finisher B, and is interposed by entrance rollers 12 to be conveyed to sheet conveyance path r1 that is below conveyance path switching section Z.

The sheet S conveyed to the sheet conveyance path r1 that is below the conveyance path switching section Z descends almost vertically, and it stops temporarily at a prescribed position to be stored. In this first stop position Q1, succeeding plural sheets S are superposed on aforesaid sheet S to be housed.

Sheet S thus housed is moved in the rectangular direction by conveyance pairs rollers 18A and 18B, first conveyance pairs of rollers 18C and 18D and by an unillustrated guide plate in the rectangular direction, then, it passes through sheet conveyance path r2 that turns round to front surface side Bf in sheet finisher B under the condition that a sheet surface is standing vertically, and it stops temporarily in second stop position Q2.

Next, the sheet S is conveyed upward vertically by second conveyance pair of rollers 18E, then, is deflected in the horizontal direction, and is moved along sheet conveyance path r3.

An unillustrated aligning section is arranged at the downstream side of sheet conveyance path r3 in the sheet conveyance direction, and sheet lining up is conducted by causing a leading edge of a sheet to hit the aligning section for positioning, and the sheet stops temporarily at third stop position Q3.

On the downstream side of the aligning section in the sheet conveyance direction, there is arranged center folding section 30. The center folding section 30 is composed of folding rollers and a folding plate, and it causes folding rollers to pass through the center of the sheet while pressing the nearly center of the sheet down, and causes folding rollers to turn round to conduct center folding.

Folded sheet SA on which folding processing is conducted by center folding device 30 and a fold portion "b" is formed is returned to its original horizontal conveyance path. The folded sheet SA continues to be conveyed to sheet conveyance path r4 in the direction of an extended line of the fold portion "b" by conveying belt 41 of conveying section 40, conveying claw 42 and by introduction guide member 51 of folded sheet guide section 50, and is sent into center stapling section 60.

As stated above, the center folding section 30 conducts center folding processing for a few sheets such as one sheet through three sheets to form fold portions "b" surely, and then, it sends them into center stapling section 60 one after another. Thereby, it is possible to prepare sheet bundles SS each having a little swelling of fold portion "b".

The folded sheet SA center folded in the center folding section 30 is moved toward sheet conveyance path r4 by conveying section 40, and is placed on saddle-shaped stacking section 61 of the center stapling section 60 (see FIG. 3). Succeeding center-folded sheet SA having been processed in term center folding also passes continuously through sheet conveyance path r4, to be stacked on the saddle-chap stacking section 61.

The saddle-shaped stacking section 61 is composed of two guide plates which cross almost at right angles each other, to be fixed on a main body of sheet finisher B. In the vicinity of a top portion of the saddle-shaped stacking section 61, there is arranged pressure member 61A that is spring-urged and is capable of going up and down under the condition to be supported by staple-receiving mechanism 64.

A top portion of the pressure member 61A is in a convex form that is almost rectangular upward, and fold portion "b" of center-folded sheet SA is placed on the ridge on its top portion.

A plurality of center-folded sheets SA placed on the saddle-shaped stacking section 61 and on pressure member 61A are aligned in terms of a position by width aligning device 62.

Stapling mechanism 63 is arranged to be fixed, above the pressure member 61A. Inside the saddle-shaped stacking section 61, pressure member 61A and staple-receiving mechanism 64 are supported to be movable upward and downward. Two sets of stapling devices of two-division construction composed of stapling mechanism 63 and staple-receiving mechanism 64 are arranged in the direction of fold portion "b" of sheet S. In operation section 9, after the center stapling processing is set, staple-receiving mechanism 64 ascends to conduct center stapling processing. In operation section 9, when center stapling is set, the staple-receiving mechanism 64 ascends to conduct center stapling processing. Namely, two sets of stapling devices drive staples SP at two locations which are symmetrical about the center, along fold portion "b" or folded sheet SA on pressure member 61A.

Sheet bundle SS that has been subjected to center stapling processing in center stapling section 60 is held by supporting member 72 fixed on a tip portion of arm member 71 of booklet taking out device 70, then, is swung by the arm member 71 in the direction of an arrow shown with a one-dot chain line, and is conveyed to bundle conveyance section 80.

The sheet bundle SS conveyed to the bundle conveyance section 80 is placed on conveyance belt 82. Owing to a rotation of the conveyance belt 82, the sheet bundle SS is conveyed downward obliquely, and it is further held aslant, and is moved by rotating conveyance belt 83 to be stopped at a prescribed position. After that, the conveyance belt 83 is swung to be supported horizontally.

Since edge a representing a free end portion on the opposite side of the fold portion "b" of the sheet bundle placed on the conveyance belt 83 that has become to be in the horizontal state is not aligned in terms of the number of sheets of the sheet bundle SS, edge portion "a" is cut to be aligned by cutting blade 121 of sheet cutting device 100 and by blade receiving member 116. Details of the sheet cutting device 100 will be described later.

Booklet SSS prepared through cutting processing is placed on the conveyance belt 83 that rotates inversely, to be conveyed under the condition where a rear end portion the booklet SSS is pressed by movable aligning member 84 that is fixed on the conveyance belt 83, and the booklet SSS falls in the direction of an arrow from a tip portion of the conveyance belt 83. The booklet SSS that has fallen is ejected in sheet ejection tray 86 arranged to be outside of front surface side Bf of sheet finisher B by ejection belt 85 that rotates.

Below booklet conveyance section 80 and sheet cutting device 100, there is arranged chip processing device 190. Chips SB resulted from cutting of edge portion "a" by cutting blade 121 of sheet cutting device 100 and by blade receiving member 116 fall on rotating chip conveyance belt 191, to be moved and stored in chip container 192.

Though an explanation has been given for sheet cutting device 100 of sheet finisher B having functions for center folding and center stapling in the present embodiment, it is also possible to apply to a sheet cutting device of a sheet finisher that conducts center folding processing after conducting preceding processing for center stapling. Or, sheet finisher B may also be a sheet bundle making apparatus such as a starching book-binding apparatus.

It is also possible to conduct processing from first to last for multipurpose and multifunctional sheet finishing, by connecting selectively sheet finisher B equipped with sheet cutting device 100 of the invention with a bookbinding machine connected to a shortrun printing machine. It is further possible to obtain same effects by applying also on a sheet finisher to be used after connection to image forming apparatus A such as a shortrun printing machine, a printer, facsimile machine and a multifunction peripheral.

[Sheet Cutting Device 100]

Figures 4A, 4B:
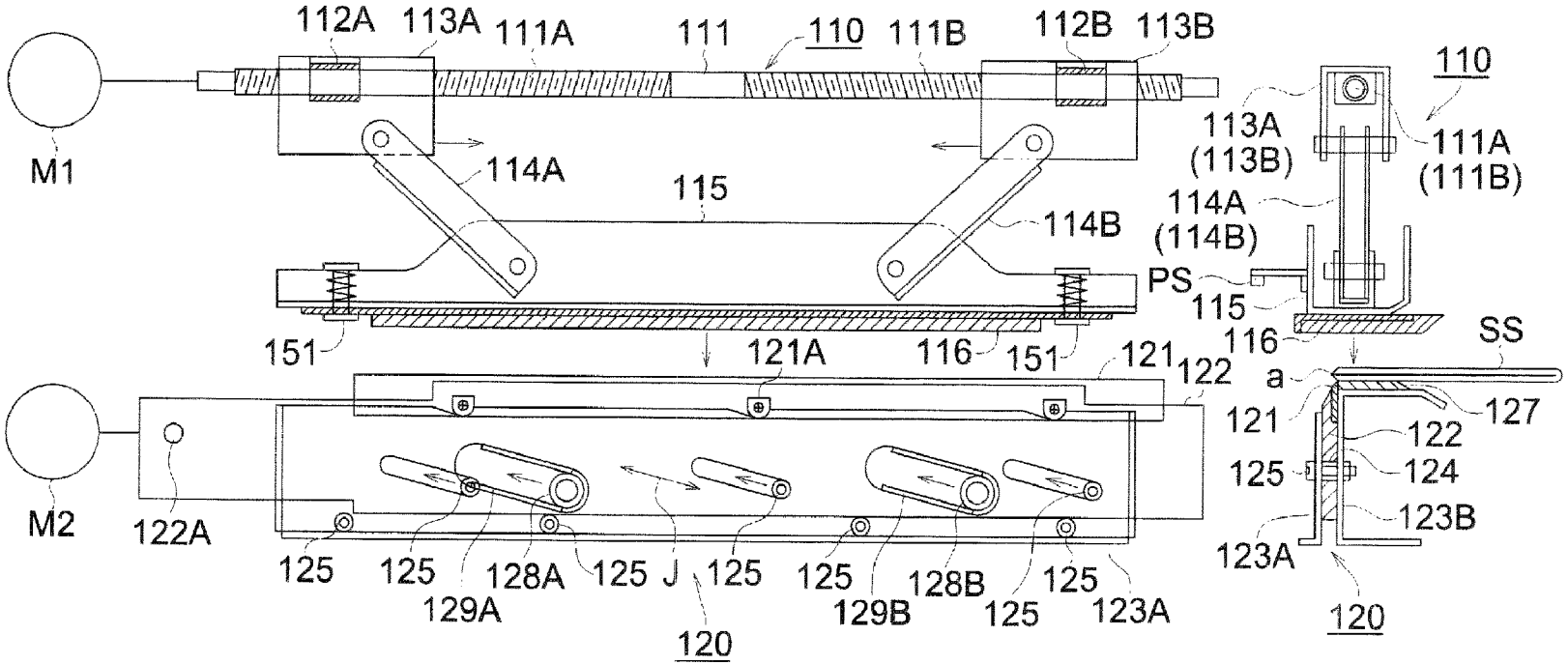
FIG. 4A is a front view of main parts showing the state of standing by for sheet cutting device 100.
FIG. 4B is its side view of main parts.

FIG. 4A is a front view of primary parts showing the state of standing by of sheet cutting device 100, and FIG. 4B is a side view of primary parts thereof.

On the upper part of a main body of sheet cutting device 100, there is arranged pressure member 110, and on the lower part of the main body, there is arranged cutting section 120.

In FIG. 4B, the numeral 127 represents a placing stand of a fixed type on which sheet bundle SS conveyed in sheet cutting device 100 is placed. The sheet placed on placing stand 127 is pressed by falling pressure section 110. The aforesaid pressure section 110 and placing stand 127 function as "an interposing section". Edge "a" of the sheet bundle SS interposed by the interposing section is cut by cutting blade 121 that is moved upward obliquely by cutting section 120.

On the bottom surface of edge pressure member 115 of pressure section 110, there is fixed "blade receiving member" that is composed of blade receiving member 116 and reinforcing sheet 117, and it conducts parallel displacement in the vertical direction together with the edge pressure member 115. The blade receiving member 116 is made of resin material. As shown in FIG. 4E, the blade receiving member is provided on the pressure section 110 side.

[Pressure Section 110]

Above the pressure section 110, there is constructed rotating shaft 111 whose both ends are supported. The rotating shaft 111 is rotated by drive motor M1. The rotating shaft 111 has thereon screw section 111A and screw section 111B whose helix angles are opposite each other, and the screw section 111A engages with screw 112A and the screw section 111B engages with screw 112B. When the rotating shaft 111 rotates, movable holder 113A that holds the screw 112A and movable holder 113B that holds the screw 112B move linearly in the opposite directions each other.

A lower end of interconnecting rod 114A that is supported on a part of the movable holder 113A to be capable of oscillating is engaged with an illustrated upper portion on the left side of the edge pressure member 115, to support it to be capable of going up and down. In the same way, a lower end of interconnecting rod 114B that is supported on a part of the movable holder 113B to be capable of oscillating is engaged with an illustrated upper portion on the right side of the edge pressure member 115, to support it to be capable of going up and down.

Therefore, the rotating shaft 111 is rotated by driving rotation of the drive motor M1, thereby, the movable holder 113A and the movable holder 113B move from side to side, and inclination angles of the interconnecting rods 114A and 114B are changed to cause the edge pressure member 115 to conduct parallel displacement in the vertical direction.

[Cutting Section 120]

Cutting section 120 is composed of a fixing device including cutting blade 121, cutting blade holder 122, supporting plates 123A and 123B, space holding member 124 and connection member 125 and of placing stand 127.

The cutting blade 121 having its cutting edge that is formed on an upper edge is fixed, and held on the cutting blade holder 122 by means of screw member 121A. The cutting blade holder 122 is supported movably between surfaces facing each other of the paired supporting plates 123A and 123B which are arranged to be in parallel. Between the surfaces facing each other of the paired supporting plates 123A and 123B, there is interposed space holding member 124, and a space between the paired supporting plates 123A and 123B is maintained so that the cutting blade holder 122 may be moved in the space.

Connecting member 125 passes through the supporting plates 123A and 123B and the space holding member 124 in a shape of hollow cylinder, to fix the supporting plates 123A and 123B by maintaining them to be in a prescribed distance.

A distance between sliding surfaces facing respectively the supporting plates 123A and 123B regulated by the space holding member 124 is set to be within a range of 0.1 to 0.5 mm for a thickness of the cutting blade holder 122, to create a gap through which the cutting blade holder 122 can go up and down smoothly.

A connecting device composed of the connecting member 125 and the space holding member 124 is arranged at each of plural positions for the supporting plates 123A and 123B, to maintain the prescribed distance firmly.

On the cutting blade holder 122, there are fixed rollers 128A and 128B, and these rollers 128A and 128B are guided respectively by guide members 129A and 129B which are arranged to be inclined downward to the right side.

Drive motor M2 representing the driving source is a drive motor that moves cutting section 120 including cutting blade 121. The drive motor M2 moves pin 122A fixed on the cutting blade holder 122 linearly from side to side as illustrated, and when the cutting blade holder 122 moves linearly from side to side through pin 122A, rollers 128A and 128B fixed on the cutting blade holder 122 move upward and downward obliquely as shown in the direction of arrow J, along guide members 129A and 129B.

Next, operations of sheet cutting device 100 will explained as follows.

In the state of standing by, movable holder 113A is positioned at a left end and movable holder 113B is positioned at a right end, while, blade receiving member 116 is located at the uppermost position, and cutting blade 121 is standing by at the lowermost position.

When sheet bundle SS is introduced into the oh cutting device 100, drive motor M1 is started to drive movable holders 113A and 113B, and edge pressure member 115 goes down through interconnecting rods 114A and 114B. At the position where the edge pressure member 115 is detected by detection sensor PS, drive motor M1 is stopped and the edge pressure member 115 is stopped. A stop position for the edge pressure member 115 is determined by position setting conducted by the detection sensor PS, and a position of the detection sensor PS is determined by the number (thickness) of sheets forming the sheet bundle SS. Therefore, a position of descending for the edge pressure member 115 is established by the number (thickness) of sheets forming the established sheet bundle SS, in an operation section of an image forming system.

In the course of sheet cutting which will be explained later, the edge pressure member 115 interposes sheet bundle SS under the high pressure so that any slippage may not occur even when force in the horizontal direction is applied on many stacked sheets by cutting blade 121.

When interposing operations for sheet bundle are completed, drive motor M2 is started to move the cutting blade 121 upward in the direction of arrow J on the left. Owing to this movement of the cutting blade 121, the sheet bundle SS is cut. Since the cutting operations by the cutting blade 121 is cutting performed by sliding of a blade, it is possible to cut with relatively small drive force, and even when the number of sheets to be cut is increased, the drive force remains unchanged, with only a change in a movement stroke of the cutting blade 121.

When edge cutting processing is completed, drive motor M2 rotates inversely, and the cutting blade 121 descends to the prescribed position that is in a lower part obliquely on the right side in FIG. 1.

When the descent of the cutting blade 121 is completed, the edge pressure member 115 ascends to the initial position.

When an unillustrated fold holding member and a receiving plate which have been interposing the vicinity of fold portion "b" of sheet bundle SF return to their initial positions after the completion of the ascendance of the edge pressure member 115, the edge pressure member 115 and the blade receiving member 116 ascend, and interposing for sheet bundle SS is released. With a series of operations described above, edge cutting processing for the sheet bundle SS is completed.

Figure 5:
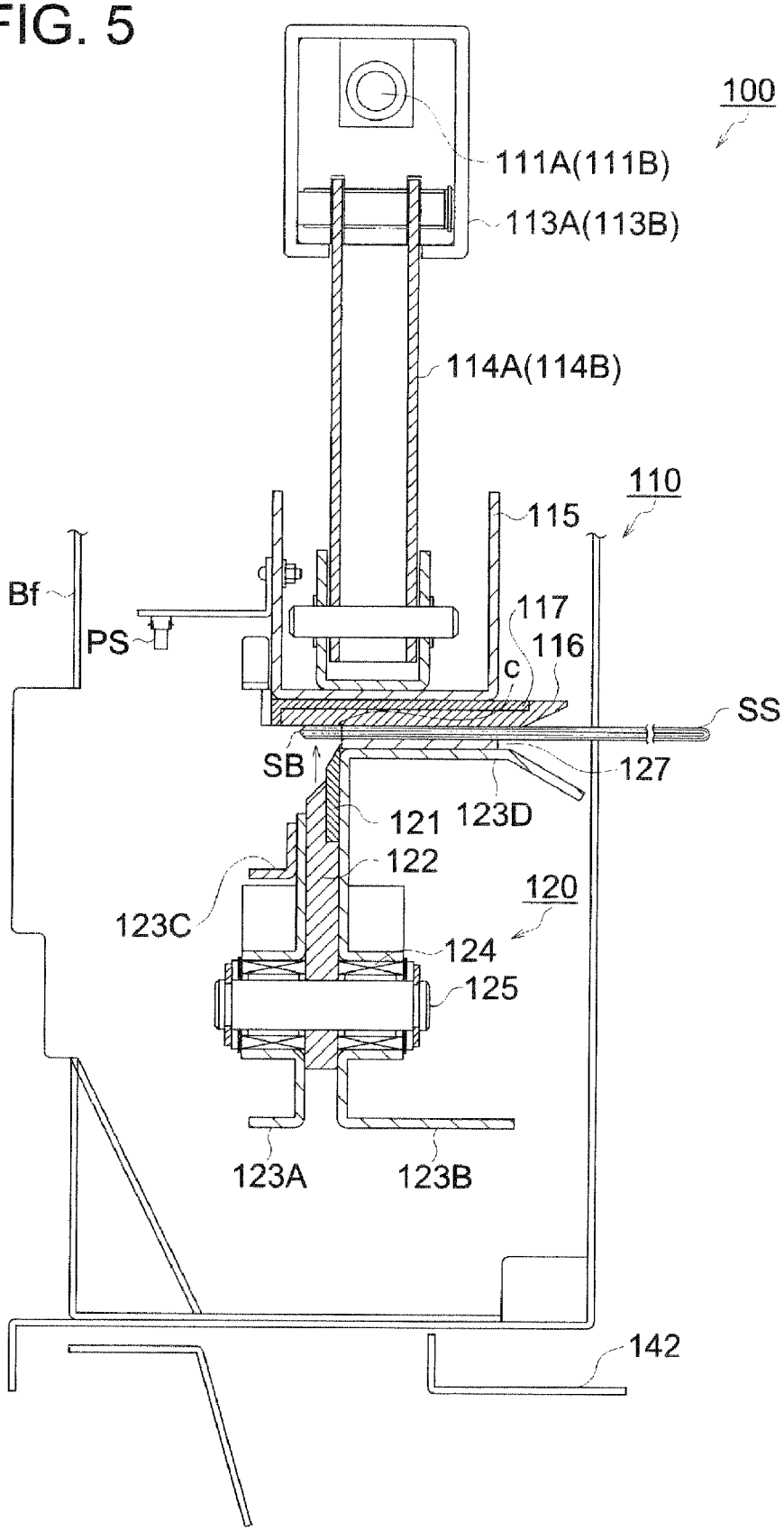
FIG. 5 is a sectional view of sheet cutting device 100.

FIG. 5 is a sectional view of sheet cutting device 100.

The sheet cutting device 100 cuts edge portion a of sheet bundle SS with cutting blade 121 that is arranged below the conveyance path for sheet bundle SS and with blade receiving member 116 arranged above the conveyance path. The cutting blade 121 is fixed on movable cutting blade holder 122. The cutting blade holder 122 is held by supporting plates 123A and 123B on a slidable basis, and, it can be moved upward obliquely by drive motor M2 in FIG. 4A.

When the cutting blade holder 122 is moved upward obliquely, the cutting blade 121 is placed on the upper surface of placing stand 127, to cut edge portion "a" of the sheet bundle SF that is pressed by the blade receiving member 116.

The blade receiving member 116 interconnects with interconnecting rods 114A and 114B which are swung by drive motor M1 serving as a driving source in FIG. 4A to go up and down, and it presses sheet bundle SS placed on the upper surface of the placing stand 127, and touches a cutting edge when the sheet bundle SS is cut. A biting amount of the cutting blade 121 into the blade receiving member 116 is made to be changeable within a range from 0.4 mm to 0.7 mm, through regulation. Details for this will be described later.

[Position Detection Section 140]

Figure 6A:
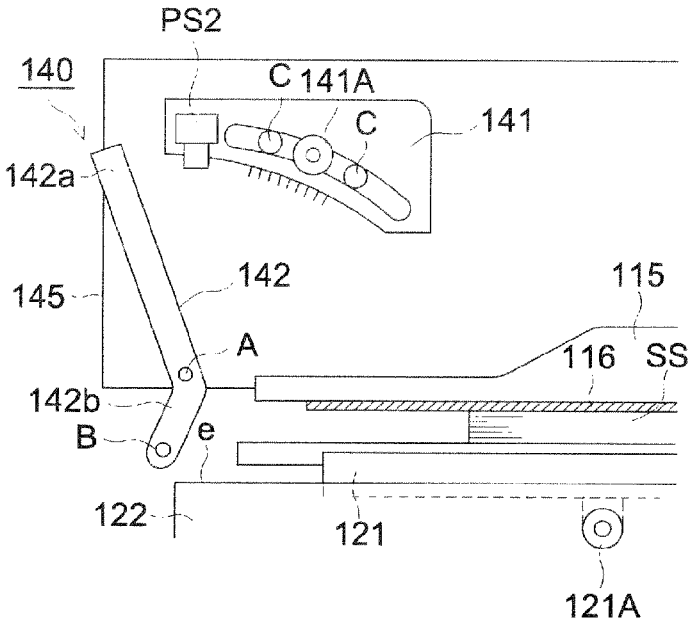
FIG. 6A is a front view of the circumference of position detection section 140 showing the state of standing by of sheet cutting device 100.
Figure 6B:
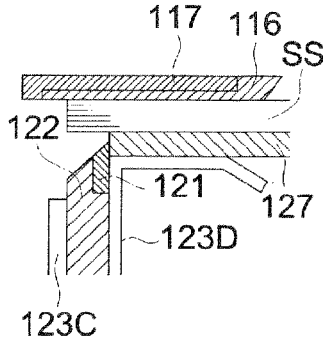
FIG. 6E is its side view.
Figure 7A:
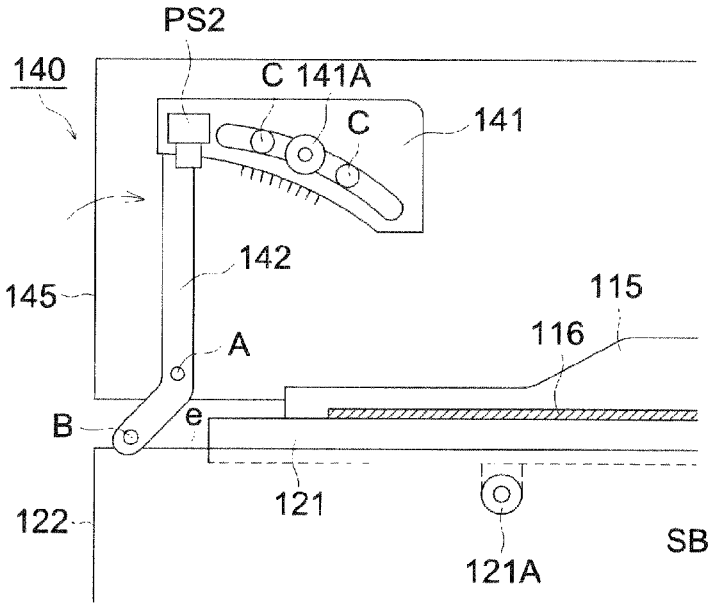
FIG. 7A is a front view of the circumference of position detection section 140 showing the state of sheet cutting for sheet cutting device 100.
Figure 7B:
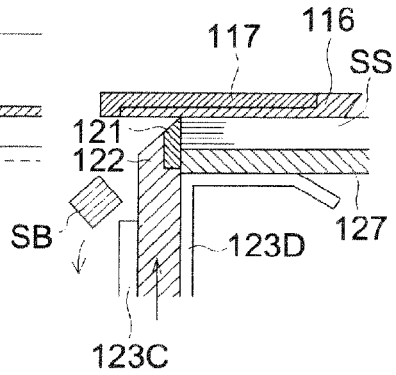
FIG. 7B is its side view.

The position detection section 140 will be explained as follows, based on FIGS. 6A and 6B and on FIGS. 7A and 7B. Each of FIGS. 6A and 6B is a diagram of the state of standing by, and each of FIGS. 7A and 7B is a diagram of the state of sheet cutting. FIG. 6A is a front view of the surroundings of the position detection section 140 showing the state of standing by of the sheet cutting device 100, and FIG. 6B is side view. FIG. 7A is a front view of the surroundings of the position detection section 140 showing the state of cutting by the sheet cutting device 100, and FIG. 7B is its side view. In the state of standing by, cutting blade 121 of cutting section 120 is at "a position of standing by".

The position detection section 140 is composed of position detection sensor PS2, guide place 141 that adjusts a position of the position detection sensor PS2 and of actuator 142.

The actuator 142 is equipped with arm 142*a* and arm 142*b*, and it rotates around a center represented by fulcrum A. During a period of standing by shown in FIGS. 6A and 6B, the actuator 142 is located at its initial position under the empty weight thereof. During a period of cutting operations shown in FIGS. 7A and 7B, a movement of the cutting blade 121 upward obliquely causes upper surface edge portion "e" the moved cutting blade holder 122 to touch contact shaft provided on arm 142*b*, and the actuator 142 rotates clockwise on the center represented by the fulcrum A as illustrated in FIG. 7A. With the aforesaid rotation of the actuator 142, a tip of the other arm 142*a* moves to a detection position of position detection sensor PS2.

The actuator 142 and the position detection sensor PS2 are fixed on the same panel 145. Further, the panel 145 is fixed to edge pressure member 115 and to blade receiving member 116. Owing to the aforesaid construction, the blade receiving member 116, the actuator 142 and the position detection sensor PS2 move up and down integrally.

A position of arrangement for the position detection sensor PS2 is adjusted by corresponding to the position of arm 142*a* under the condition that a distance between blade receiving member 116 and a cutting edge of the cutting blade 121 is a prescribed value, for example, a value of 0.0 mm to −0.4 mm (a symbol minus represents the direction of biting). Adjustment of a position of arrangement for the position detection sensor PS2 can be carried out by sliding guide plate 141 along pins C and C, and guide plate 141 is fixed on panel 145 by screw member 141A.

Since detection signals of the position detection sensor PS2 can detect that the cutting blade 121 has arrived at a prescribed position, signals for stopping are sent to drive motor M2 based on detection signals, to stop the cutting blade 121.

Though the cutting blade 121 is stopped based on detection signals of the position detection sensor PS2, in the present embodiment, it is also possible to provide a mechanical stopper that touches the cutting blade holder 122 at a prescribed position, and thereby to stop the cutting blade 121 at a prescribed position with the mechanical stopper. It is further possible to create a construction wherein the stop position can be varied by changing a position for the mechanical stopper.

[Shifting Section 160]

Figure 8:
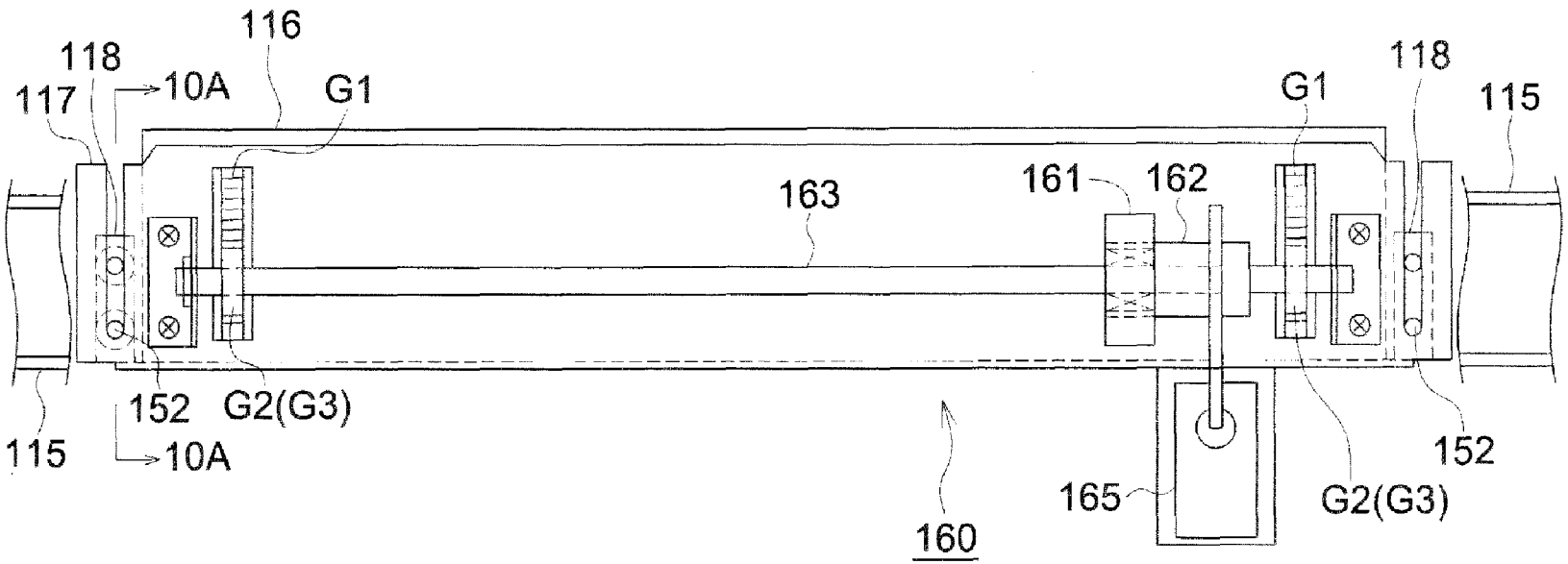
FIG. 8 is a plan view of shifting section 160 and the circumstances of blade receiving member 116.
Figure 9:
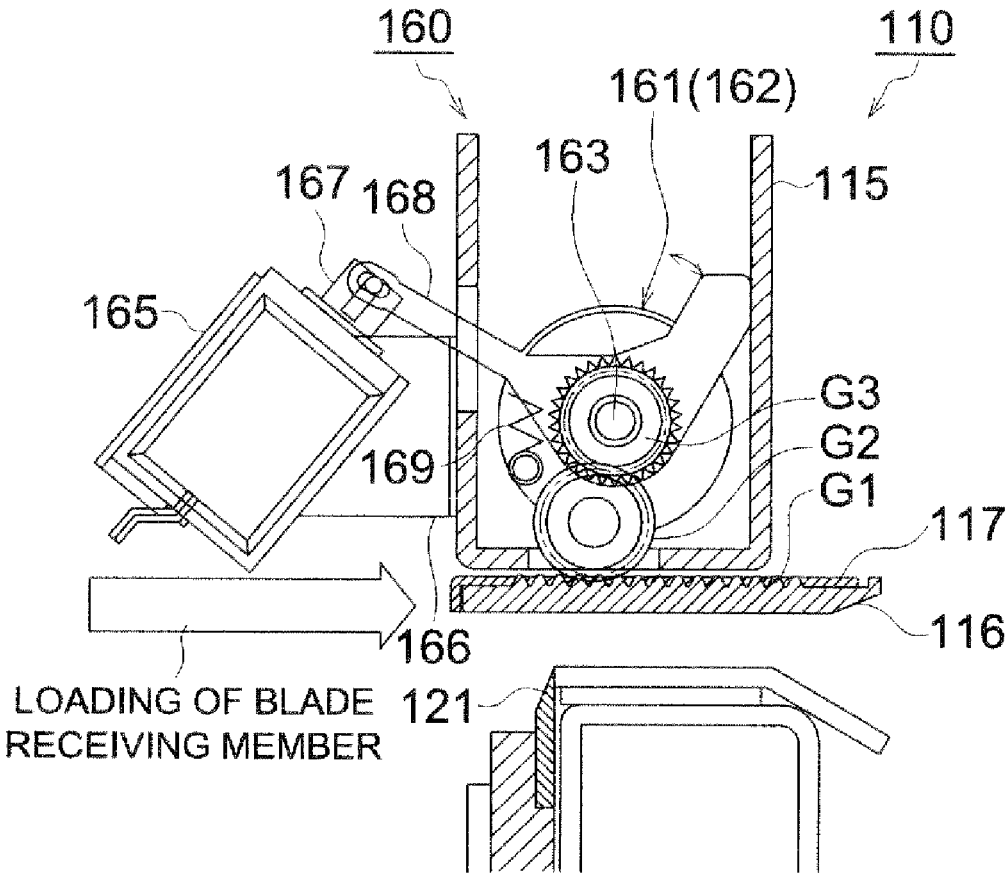
FIG. 9 is a sectional view of shifting section 160 and the circumstances of blade receiving member 116.

FIG. 8 is a plan view of shifting section 160 and of the circumstances of blade receiving member 116, and FIG. 9 is a sectional view of the same. In the shifting section 160, a blade receiving member that is composed of blade receiving member 116 and reinforcing sheet 117 is shifted in the direction intersecting a cutting surface (direction of cutting edge) of the cutting blade 121 at right angles.

Pinion gear G2 that engages with rack gear G1 of blade receiving member 116 is engaging with drive gear G3 constantly. The pinion gear G2 is engaging with the rack gear G1 constantly, when feeding the blade receiving member 116 on an incremental basis. Further, the pinion gear G2 engages with the rack gear G1 as occasion demands when mounting and dismounting the blade receiving member 116.

On shaft 163 that is supporting the drive gear G3, there are arranged torque limiter 161 and one-way clutch 162. On the side surface of edge pressure member 115, there arranged solenoid 165 that is fixed on supporting plate 165. Lever 168 connected with plunger 167 of the solenoid 165 is connected to drive gear G3, and each time the plunger 167 drives for suction, the lever 168 is vibrated to advance the drive gear G3 counterclockwise in the illustration on an incremental basis for one tooth of the gear. The pinion gear G2 engaging with the drive gear G3 rotates clockwise in the illustration, to advance (shift) the blade receiving member 116 having rack gear G1 toward the left side in the illustration on an incremental basis. The numeral 169 represents a spring that generates idling torque of the torque limiter. An amount of a single advancement for the blade receiving plate is established, for example, to be about 1.0 mm.

The one-way clutch 162 prevents an inverse rotation of drive gear G3 when the plunger 167 of the solenoid 165 operates returning operations. Further, when returning operations of the lever 168 are completed, an end portion of the lever 168 touches an inner wall of the edge pressure member 115 to stop oscillation of the lever 168. Incidentally, the direction for shifting a blade receiving member does not always need to be the direction to intersect the cutting edge of cutting blade 121 at right angles, and direction to intersect simply is accepted.

[Mounting Blade Receiving Member]

Figure 10A:
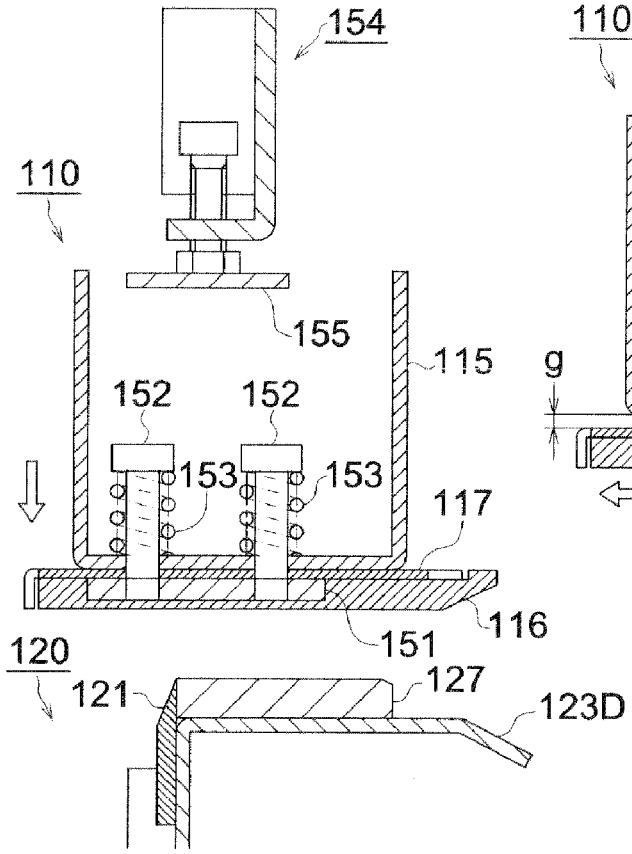
FIG. 10A is an 10A-10A sectional view showing the state wherein blade receiving member 116 is pressure-connected to edge pressure member 115.

FIG. 10A is a sectional view taken on line 10A-10A (see showing the state wherein blade receiving member 116 is pressure-connected to edge pressure member 115. The blade receiving member 116 that is pressure-connected to edge pressure member 115 of pressure member 110 stops while keeping a prescribed distance from cutting blade 121 of lower cutting section 120. In this stop position, sheet bundle SS is introduced.

Stop member 154 fixed on a main body of the apparatus is arranged above the edge pressure member 115. Stop surface 155 on the bottom portion of the stop member 154 and a top surface of pressure bar 152 are kept to be in the state where both of them are away from each other.

Figure 10B:
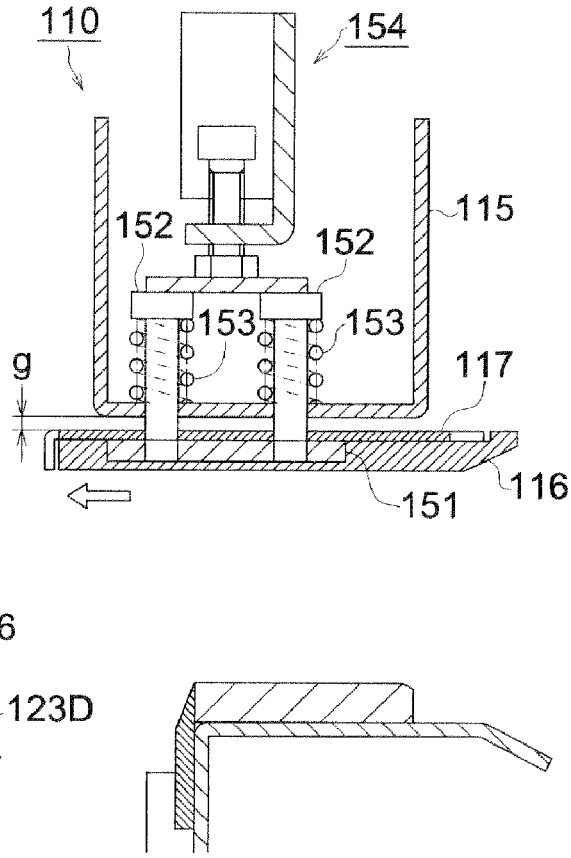
FIG. 10B is an 10A-10A sectional view showing the state wherein blade receiving member 116 is away from edge pressure member 115.

FIG. 10B is a sectional view taken on line 10A-10A (see FIG. 8) showing the state wherein the blade receiving member 116 is away from edge pressure member 115. Drive motor M1 shown in FIGS. 4A-4B drives edge pressure member 115 of pressure member 110 to ascend and drives a top surface of pressure bar 152 to touch the stop surface 155 on the bottom portion of the stop member 154. Then, when the edge pressure member 115 ascends, pressure bar 152 is pressed down by the stop member 154, and pressure-connection plate 151 that is united with the pressure bar 152 is also pressed down, thus, a bottom surface of the edge pressure member 115 and a top surface of reinforcing sheet 117 are separated from each other, and clearance section g is formed.

When the blade receiving member 116 is gripped to be fed out in the direction of an outlined arrow in the illustration, to be pushed in the clearance section "g" formed between the edge pressure member 115 and the pressure-connection plate 151 shown in FIG. 9, rack gear G1 of the blade receiving member 116 rotates pinion gear G2, and rotates drive gear G3 against torque pressure of torque limiter 161, to stop the blade receiving member 116 at a prescribed position.

When the blade receiving member 116 is taken out of the clearance section "g" formed between the edge pressure member 115 and the pressure-connection plate 151, pinion gear G2 is rotated regularly by rack gear G1 of the blade receiving member 116, and drive gear G3 and one-way clutch 162 are yen to rotate.

[Control Flow]

Figure 11:
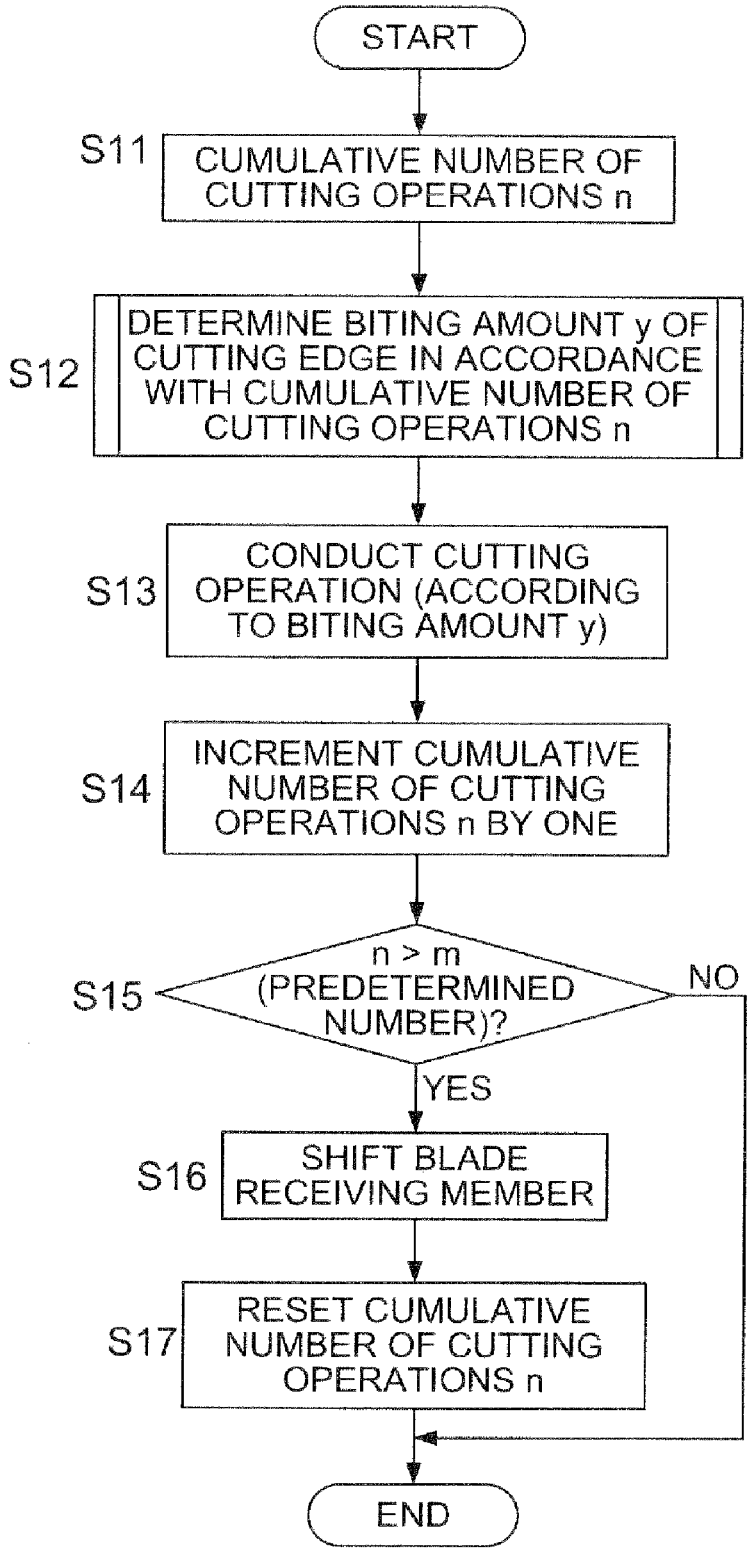
FIG. 11 shows contents of a control flow which are carried out by sheet finishing control device 10E of sheet finisher B.

Next, a control flow will be explained. FIG. 11 shows contents of a control flow which are carried out by sheet finisher control section 10B of sheet finisher B.

In step S11, information of cumulative number of cutting operations "n" up the present time is acquired.

In step S12, biting amount "y" for a cutting edge corresponding to cumulative number of cutting operations "n" acquired in step S11 is determined based on a correspondence table shown in Table 1.

TABLE 1

| Cumulative number of cutting operations n | Biting amount y (Amount of movement x) |
|---|---|
| 1-250 | 0.4 mm(tss + 5.4 mm) |
| 251-500 | 0.5 mm(tss + 5.5 mm) |
| 501-750 | 0.6 mm(tss + 5.6 mm) |
| 751-000 | 0.7 mm(tss + 5.7 mm) |

Table 1 is a correspondence table showing relationship between cumulative number of cutting operations "n" and biting amount "y" for a cutting edge of cutting blade 121.

Contents of this correspondence table are stored in a memory section of sheet finisher control device 10B.

The parenthesized numerical values in Table 1 are those showing amount of movement "x" of a cutting edge of cutting blade 121 to the blade receiving member 116. The symbol tss represents a thickness of sheet bundle SS, and thickness tss may be calculated either by measuring a distance from edge pressure member 115 to placing stand 127 in the case of interposing sheet bundle SS, or by converting based on the number of sheets of sheet bundle SS. As shown in Table 1, the amount of movement "x" from the position of standing by the stop position for cutting blade 121 of cutting section 120 (or biting amount "y") is made to be large with an increase of the number of times for cutting in the present embodiment. Incidentally, the amount of movement "x" mentioned here means an amount of movement in the direction perpendicular to a surface of sheet bundle SS among movement amounts of cutting blade 121.

Figure 12:
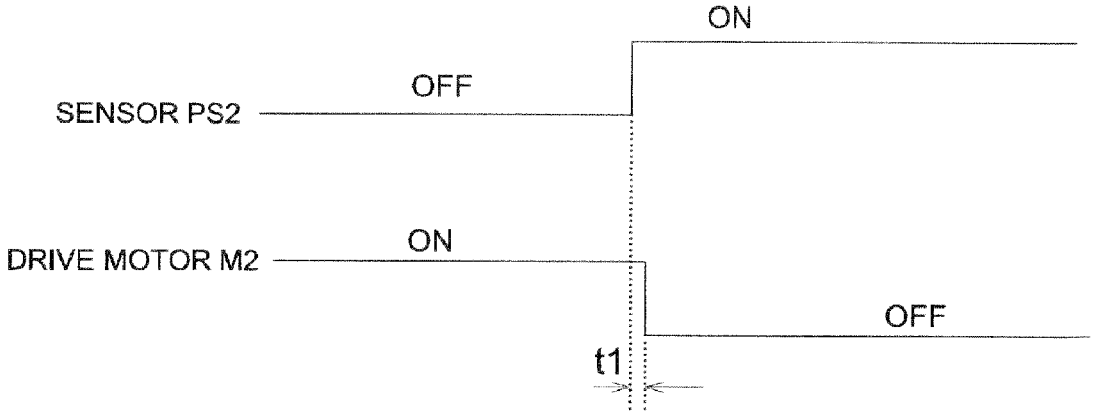
FIG. 12 is a timing chart showing timing of position detection sensor PS2 and timing of drive motor M2 that moves cutting blade 121.

Now, how change the biting amount y will be explained. FIG. 12 is a timing chart showing timing for position detection sensor PS2 and for drive motor M2 that moves cutting blade 121. In the present embodiment, when prescribed delay time t1 (a period of time up to outputting stop signals) has passed from the moment of detection signals by the position detection sensor PS2, stop signals are outputted to drive motor M2, and cutting blade 121 is stopped. As explained in the aforesaid FIGS. 6A and 6B and FIGS. 7A and 7B, the position detection sensor PS2 is established so that it can detect when a distance between cutting blade 121 and blade receiving member 116 satisfies prescribed relationship. For example, under the condition that a distance between a cutting edge of cutting blade 121 and blade receiving member 116 is set to be −0.4 mm (biting amount 0.4 mm), if delay time t1 is made to be zero, a biting amount of the cutting edge into the blade receiving member 116 is 0.4 mm. The biting amount "y" can be increased by prolonging the delay time t1.

In returning to the explanation of the control flow in FIG. 11, the cutting blade 121 is moved upward by cutting section 120, in step S13, based on biting amount "y" cutting edge acquired in step S12.

In step S14, cumulative number of cutting operations "n" is incremented. Then, in step S15, the cumulative number of cutting operations "n" thus incremented is judged whether it exceeds prescribed number "m" or not. The prescribed number "m" in this case means the maximum number of times for a blade receiving plate to be used at one position, and prescribed number of times "m" in the present embodiment is set to 1000 times. Meanwhile, in the present embodiment, biting amount "y" up to a stop position (amount of movement "x") is judged whether it exceeds a prescribed upper limit value or not, by judging the prescribed number of whether it is exceeded or not, in the present embodiment.

When the prescribed number of times "m" is judged to exceeded (Yes in step S15), the blade receiving member is shifted by shifting section 160 to be in the direction perpendicular to a cutting surface.

Owing to this shifting, a surface of contact between blade receiving member 116 and cutting blade 112 is updated, thereby, the cumulative number of cutting operations "n" is reset (being set to zero) for a termination. Incidentally, resetting of the cumulative number of cutting operations "n" causes the biting amount "y" (amount of movement "x") to set again to the initial value.

In the present embodiment, control is taken to make a biting amount of a blade of cutting section up to the stop position (an amount of movement) to be large, with an increase of the number of times for cutting (cumulative number of cutting operations). By doing this, it is possible to prevent occurrence of defective cutting in advance even when blade receiving member 116 is deteriorated unexpectedly, because an amount of biting into the blade receiving member 116 grows greater gradually.

Further, by controlling so that a biting amount grows greater gradually with an increase of the cumulative number of cutting operations as stated above, it is possible to increase the number of times for the blade receiving member 116 to be used for one surface (prescribed number of times "m"). Though the aforesaid prescribed number of times "m" was 700 in the case of using under the fixed condition of biting amount of 0.5 mm, in Comparative Example, the prescribed number of times "m" was 1000 as stated above in the present example, resulting in an increase of the number of times to be used, in a comparison with the Comparative Example, which has become possible to prolong the life of a blade receiving section.

In the present embodiment, it is possible to increase a biting amount of a cutting edge into a blade receiving member gradually, by controlling so that an amount of movement of a blade of the aforesaid cutting section from a position of standing by to the aforesaid stop position may grow greater with an increase of the number of times for cutting, thus, it is possible to utilize a blade receiving section effectively. Therefore, it is possible to provide a sheet cutting device wherein occurrence of defective cutting can be lowered and a life of the blade receiving section can be prolonged.

What is claimed:

1. A sheet cutting device comprising:

an interposing section that interposes a sheet bundle in which a plurality of sheets are bundled;

a cutting blade section having a cutting blade that cuts the sheet bundle interposed by the interposing section;

a blade receiving member that receives a cutting edge of the cutting blade when a cutting operation is performed; and a controller that controls a stop position of the cutting blade when the cutting operation is performed, wherein the stop position is a position where the cutting blade bites into the blade receiving member and stops, and wherein the controller controls the cutting blade section so that an amount of movement from a standby position of the cutting blade to the stop position becomes greater in accordance with a number of times of cutting operations.

2. The sheet cutting device of claim 1, further comprising a shifting section which shifts the blade receiving member in a direction intersecting the cutting edge of the cutting blade, wherein when the amount of movement of the cutting blade from the standby position to the stop position reaches a predetermined upper limit value, the controller causes the shifting section to shift the blade receiving member, and resets the amount of movement of the cutting blade from the standby position to the stop position to an initial value.

3. The sheet cutting device of claim 1, further comprising a position detection sensor which detects a position of the cutting blade, wherein the controller changes the amount of movement of the cutting blade by changing a period of time from a moment when the position of the cutting blade is detected by the position detection sensor to a moment when a stop signal to a drive source to move the cutting blade is outputted.

4. The sheet cutting device of claim 3, wherein the controller changes the amount of movement of the cutting blade from the standby position to the stop position by changing a biting amount of the cutting blade into the blade receiving member.

5. The sheet cutting device of claim 1, wherein the interposing section comprises a fixed placing stand on which the sheet bundle is placed, and a pressure section which presses the sheet bundle, wherein the blade receiving member is provided on the pressure section.

6. An image forming system comprising:

an image forming apparatus that forms an image on a sheet; and a sheet finisher which comprises the sheet cutting device of claim 1, which forms the sheet bundle by bundling sheets with images formed thereon by the image forming apparatus, and which cuts the sheet bundle with the sheet cutting device.

7. A sheet cutting device comprising:

an interposing section that interposes a sheet bundle in which a plurality of sheets are bundled;

a cutting blade section having a cutting blade that cuts the sheet bundle interposed by the interposing section;

a blade receiving member that receives a cutting edge of the cutting blade when a cutting operation is performed; and a controller that controls a stop position of the cutting blade when the cutting operation is performed, wherein the stop position is a position where the cutting blade comes into contact with the blade receiving member and stops, and wherein the controller controls the cutting blade section so that an amount of movement from a standby position of the cutting blade to the stop position becomes greater in accordance with a number of times of cutting operations.

8. The sheet cutting device of claim 7, further comprising a shifting section which shifts the blade receiving member in a direction intersecting the cutting edge of the cutting blade, wherein when the amount of movement of the cutting blade from the standby position to the stop position reaches a predetermined upper limit value, the controller causes the shifting section to shift the blade receiving member, and resets the amount of movement of the cutting blade from the standby position to the stop position to an initial value.

9. The sheet cutting device of claim 7, further comprising a position detection sensor which detects a position of the cutting blade, wherein the controller changes the amount of movement of the cutting blade from the standby position to the stop position by changing a period of time from a moment when the position of the cutting blade is detected by the position detection sensor to a moment when a stop signal to a drive source to move the cutting blade is outputted.

10. The sheet cutting device of claim 7, wherein the interposing section comprises a fixed placing stand on which the sheet bundle is placed, and a pressure section which presses the sheet bundle, wherein the blade receiving member is provided on the pressure section.

11. An image forming system comprising:

an image forming apparatus that forms an image on a sheet; and a sheet finisher which comprises the sheet cutting device of claim 7, which forms the sheet bundle by bundling sheets with images formed thereon by the image forming apparatus, and which cuts the sheet bundle with the sheet cutting device.

* * * * *